United States Patent [19]

Miller et al.

[11] Patent Number: 4,789,078

[45] Date of Patent: Dec. 6, 1988

[54] WASTEBASKET WITH LID CATCH

[75] Inventors: David C. Miller, Ridgefield; Thomas J. Pendleton, Danbury, both of Conn.

[73] Assignee: Mobil Oil Corporation, New York, N.Y.

[21] Appl. No.: 109,877

[22] Filed: Oct. 19, 1987

[51] Int. Cl.[4] ..... B65D 43/24

[52] U.S. Cl. ..... 220/335; 220/1 T

[58] Field of Search ..... 220/335, 1 T

[56] References Cited

U.S. PATENT DOCUMENTS

| | | | |
|---|---|---|---|
| 1,037,265 | 9/1912 | Kirkpatrick . | |
| 2,145,613 | 1/1939 | Shenk et al. . | |
| 2,421,740 | 6/1947 | Birch, Jr. . | |
| 2,987,216 | 6/1961 | Fletcher . | |
| 3,070,829 | 1/1963 | Peras . | |
| 3,204,866 | 9/1965 | Brighton et al. . | |
| 3,240,375 | 3/1966 | Burrows | 220/335 X |
| 3,443,745 | 5/1969 | Kleeberg . | |
| 3,529,766 | 9/1970 | Mott, Sr. et al. . | |
| 3,531,823 | 10/1970 | Cornelius . | |
| 3,556,395 | 1/1971 | Herman . | |
| 3,563,452 | 2/1971 | Cantella . | |
| 3,567,065 | 3/1971 | Dinse . | |
| 3,603,542 | 9/1971 | Grille . | |
| 3,653,620 | 4/1972 | Benoit . | |
| 3,779,419 | 12/1973 | Heitz . | |
| 3,827,348 | 8/1974 | Hennells . | |
| 3,841,466 | 10/1974 | Hoffman et al. . | |
| 3,860,141 | 1/1975 | Hawk . | |
| 3,888,386 | 6/1975 | Svensson . | |
| 4,032,037 | 6/1977 | Dubery et al. | 220/335 |
| 4,069,965 | 1/1978 | Maddox, Jr. . | |
| 4,128,055 | 12/1978 | Hellmann . | |
| 4,244,612 | 1/1981 | Schurman . | |
| 4,262,607 | 4/1981 | Krebs . | |
| 4,282,983 | 4/1981 | Swartzbaugh . | |
| 4,291,818 | 9/1981 | Nozawa et al. . | |
| 4,325,492 | 4/1982 | Kunze | 220/1 T X |
| 4,338,979 | 7/1982 | Dow . | |
| 4,362,118 | 12/1982 | Koch, Jr. et al. . | |
| 4,399,928 | 8/1983 | Klingler . | |
| 4,441,637 | 4/1984 | Libit . | |
| 4,448,327 | 5/1984 | Gahm . | |
| 4,488,697 | 12/1984 | Garvey . | |
| 4,550,440 | 10/1985 | Rico . | |
| 4,574,944 | 3/1986 | Gregory | 220/335 X |
| 4,595,115 | 6/1986 | Huynh . | |
| 4,598,838 | 7/1986 | Zakrajsek . | |
| 4,634,019 | 1/1987 | Pherigo . | |

FOREIGN PATENT DOCUMENTS

| | | |
|---|---|---|
| 478788 | 11/1951 | Canada . |
| 400890 | 4/1966 | Switzerland . |

*Primary Examiner*—Steven M. Pollard

*Attorney, Agent, or Firm*—Alexander J. McKillop; Michael G. Gilman; Charles J. Speciale

[57] ABSTRACT

A wastebasket includes a container having an upper rim defining an open end, and a lid mounted on the container at its upper rim. The lid is positionable to cover and uncover the open end. The lid is pivotable between a closed position, where it covers the open end of the container, and an open position, where it is disposed in a substantially upright position uncovering the open end of the container. The lid and container include portions which are used for latching the lid in the upright, open position so that the lid will not fall inadvertently. The container latching portion includes a rib having an exposed corner and a recess. The lid latching portion is resiliently yieldable and includes a protrusion which is adapted to ride over the corner and snap into recess of the container rib when the lid is in the open position.

6 Claims, 5 Drawing Sheets

Fig. 2
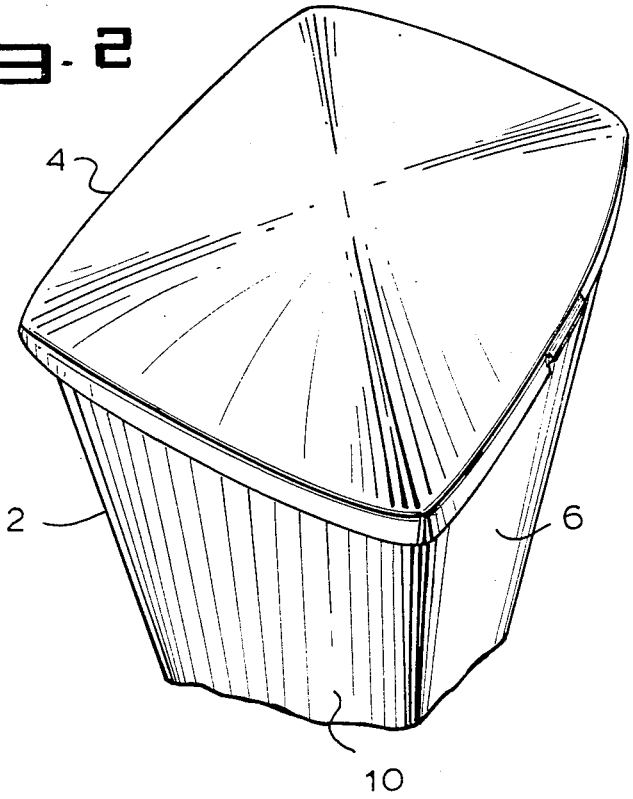
Fig. 1
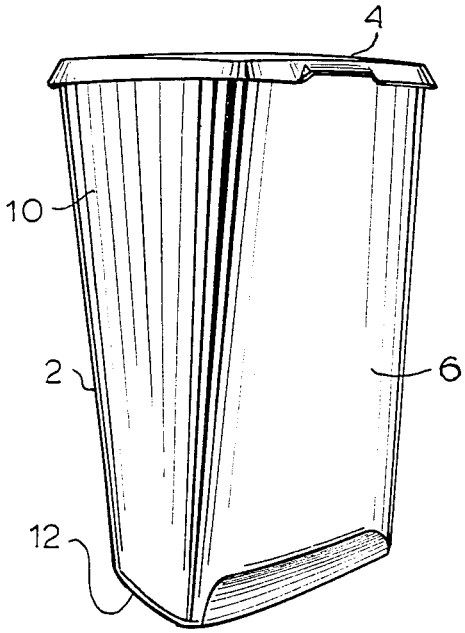
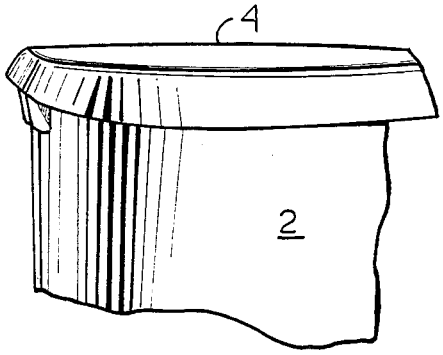
Fig. 3

Fig. 10
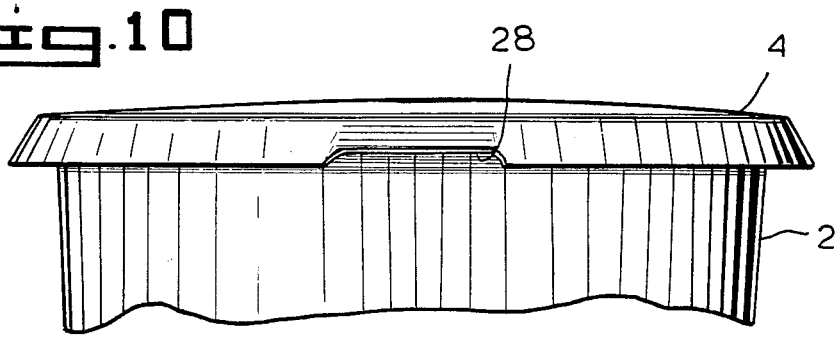
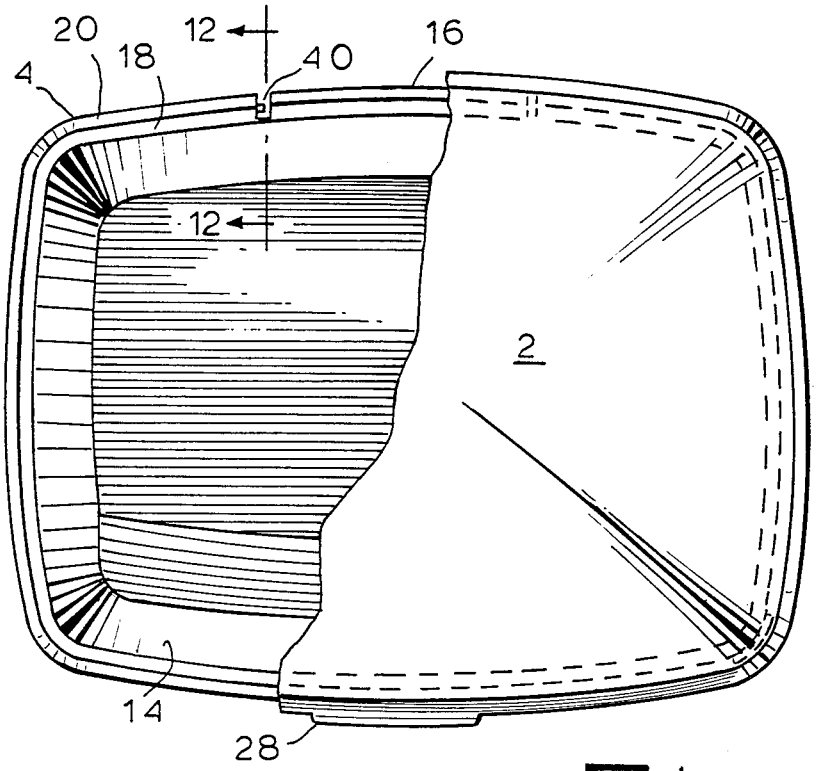
Fig. 11
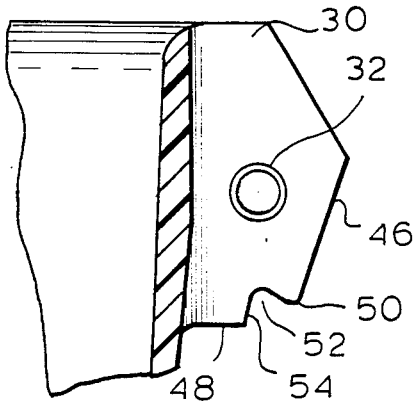
Fig. 12

Fig. 13
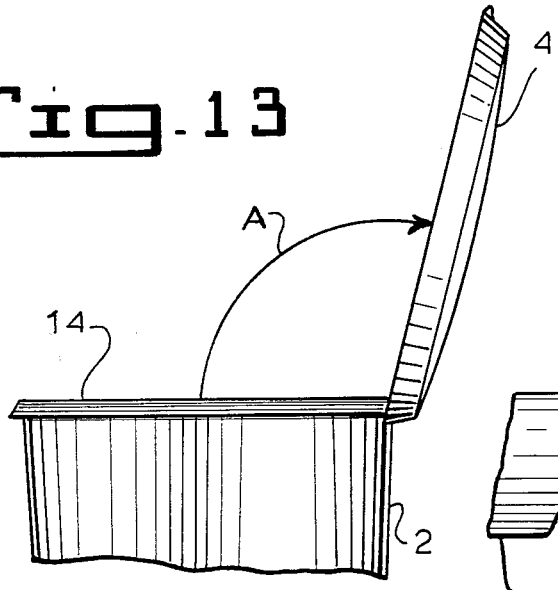
Fig. 15
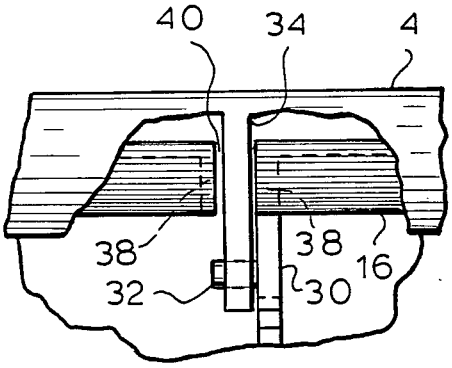
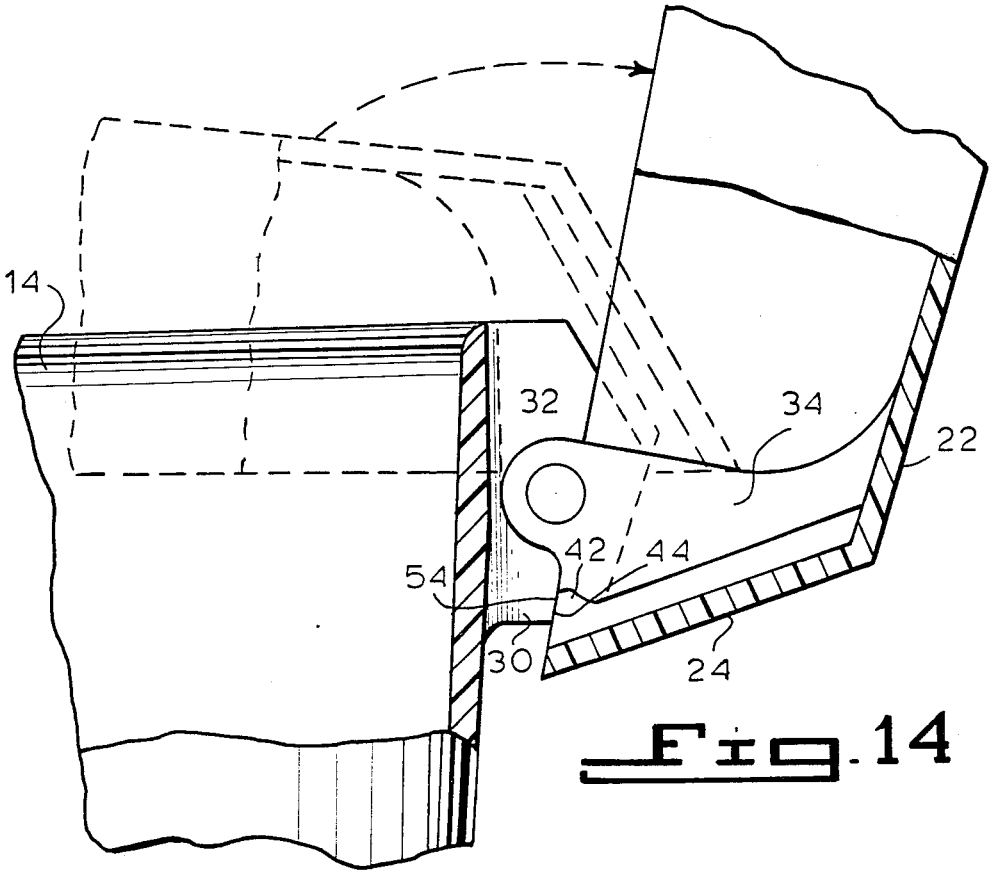
Fig. 14

WASTEBASKET WITH LID CATCH

BACKGROUND OF THE INVENTION

1. Field of the Invention

This invention relates to a wastebasket or trash receptacle, and more particularly relates to a wastebasket with a hinged lid and a lid catch which maintains the lid in an upright position.

2. Description of the Prior Art

Wastebaskets or trash receptacles having lids which may be raised to a substantially upright position so that a top opening in the wastebasket is unobstructed are well known in the art. One such wastebasket is disclosed in U.S. Pat. No. 4,325,492, which issued to Walter Kunze.

The receptacle disclosed in the Kunze patent includes a container 11 and a lid 12 pivotally mounted on the container. The lid swings upwardly and slightly backwardly of the pivot axis so that the lid does not obstruct the top opening of the container. This allows the receptacle to be stacked in other similar receptacles with their lids attached. The lid is formed with a stop surface 18 which rests on the rim 7 of the container to keep the lid in a raised position.

The manner disclosed in the Kunze patent of keeping the lid in an upright position by having it rest on a portion of the container is typical of many known trash receptacles and has its disadvantages. One of the more obvious disadvantages of not latching the lid in an upright position is that it can easily fall if either the container or the lid is disturbed. This problem would be even more annoying with the typical, lightweight household wastebasket which receives an inner liner. Because household wastebaskets are so light, any jarring movement of the wastebasket, such as when a filled inner liner is removed, will tend to knock the lid down if the lid is merely resting on the wastebasket rim in an upright position, that is, without some type of lid catch to keep the lid open.

OBJECTS AND SUMMARY OF THE INVENTION

It is an object of the present invention to provide a wastebasket for household use, which wastebasket has a lid that may be raised to an upright position and latched in this position.

It is another object of the present invention to provide a household wastebasket which is simple in construction and which may be typically formed from only two main components.

It is a further object of the present invention to provide a simple latching mechanism for a wastebasket, which mechanism maintains the lid of the wastebasket in an upright position.

It is still another object of the present invention to provide a wastebasket that overcomes the inherent disadvantages of known wastebaskets.

A wastebasket constructed in accordance with one form of the present invention includes a container having an upper rim defining an open end, and a lid mounted on the container at the upper rim. The lid is positionable to cover and uncover the open end of the container.

The wastebasket is also provided with structure for latching the lid in an upright, open position and for mounting the lid so that it pivotally swings with respect to the container. For this purpose, the container is formed with a pair of ribs situated on its rear side wall and extending downwardly from the container rim. A mounting pin projects outwardly from the side of each rib. A pair of mating lid ribs depend from the underside of the lid near its rear edge. Each rib of the lid includes an aperture formed through its thickness. The apertures of the lid ribs receive the mounting pins of the container ribs. In this manner, the lid is pivotally mounted on the container.

Each rib of the container is formed with an exposed edge having a protruding corner and a recess formed in the underside edge of the rib, that is, between the corner and the rear side wall of the container.

The lid is formed with a peripheral rim and with protrusions at the edge of the inside surface of its rim in the vicinity of the depending lid ribs. When the lid is raised, the protrusions engage the corners of the container ribs. The lid rim and its protrusions are resiliently yieldable and are outwardly displaced when the protrusions engage corresponding corners of the container ribs so that the protrusions ride over the corners and come to rest in the recesses formed in the underside of the container ribs. The recesses conform to the shape of the protrusions and are deep enough to retain the protrusions in place.

The recesses are situated on the underside of their respective container ribs such that the lid will be in substantially upright, open position, and will be retained in this position when the lid protrusions are properly seated in the container rib recesses.

A preferred form of the wastebasket, as well as other embodiments, objects, features and advantages of this invention, will be apparent from the following detailed description of illustrative embodiments thereof, which is to be read in connection with the accompanying drawings.

BRIEF DESCRIPTION OF THE DRAWINGS

FIG. 1 is a front perspective view of a wastebasket formed in accordance with the present invention.

FIG. 2 is a top perspective view of a portion of the wastebasket shown in FIG. 1.

FIG. 3 is a side perspective view of a portion of the wastebasket shown in FIG. 1.

FIG. 10 is a front view of a portion of the wastebasket.

FIG. 11 is a top view of the wastebasket with the lid partially broken away.

FIG. 12 is a partial sectional view of the wastebasket taken along line 12—12 of FIG. 11.

FIG. 13 is a side elevation view of the wastebasket, illustrating the pivotal movement of the lid.

FIG. 14 is an enlarged view of the latching mechanism used in the wastebasket.

FIG. 15 is an enlarged, fragmentary rear view of the lid mounting structure.

DETAILED DESCRIPTION OF THE PREFERRED EMBODIMENTS

Figure 4:
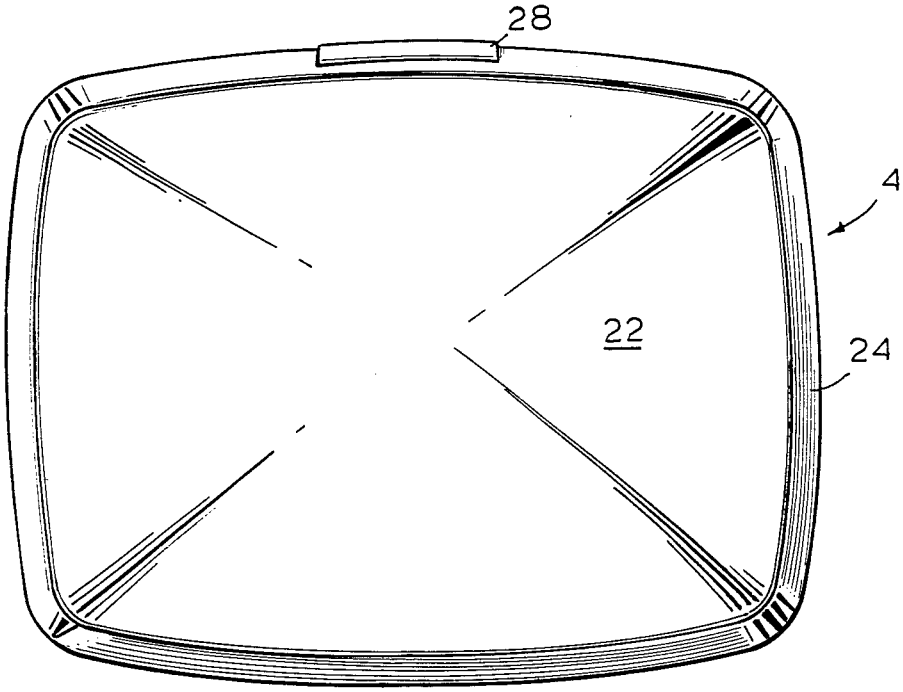
FIG. 4 is a top elevational view of the lid of the wastebasket.

Referring now to FIGS. 1 through 7 of the drawings, it will be seen that a wastebasket constructed in accordance with one form of the present invention includes a container 2 and a lid 4 pivotally mounted on the container. Although the container 2 may have various shapes, it is shown in the drawings as including front and rear side walls 6, 8 and opposite lateral side walls 10, and a bottom wall 12, all of which are joined together.

The container 2 includes an open end 14 which is defined by an upper rim 16. The upper rim 16 is downturned on the outside of the container to provide the container with structural rigidity at its open end. More specifically, the container rim 16 includes a flat, horizontal portion 18, and a downwardly sloping edge portion 20 joined to the horizontal portion.

The lid 4 is pivotally mounted on the container near its open end 14. Its basic shape conforms to that of the container rim 16 so that the lid may be mounted closely on the container rim.

More specifically, the lid includes a top wall 22, and a rim 24 which extends downwardly from and peripherally about the top wall. The lid rim 24 slopes at approximately the same angle to the vertical as the edge portion 20 of the container rim so that the lid rim overlaps and hides the container rim 16 when the lid is properly seated on the container and covering the open end.

The lid 4 further includes two support members 26 which project downwardly from the underside of the lid's top wall 22. The support members 26 engage the horizontal portion 18 of the container rim at the two front corners of the container, and function to support the lid on the rim 16 of the container.

The lid also includes a recessed handle 28 formed in the front portion of the lid's rim 24. The width of the recessed handle 28 is slightly greater than a person's hand, and is provided so that the lid can be easily raised and lowered to uncover and cover the open end 14 of the container.

With reference to FIGS. 9 through 15 of the drawings, the structure for mounting the lid 4 on the container 2 and for latching the lid in a substantially upright, open position will now be described.

The container 2 includes hinge members for mounting the lid on the container. In their preferred form, the container hinge members are a pair of spaced apart ribs 30 formed as flat, plate-like members which extend outwardly from the container rear side wall 8 and which project downwardly from the container rim 16. Each rib 30 includes a mounting pin 32 which projects outwardly from a side of the rib which faces the other rib 30.

Similarly, the lid 4 includes hinge members, which are preferably a pair of depending ribs 34 affixed to the underside of the lid's top wall 22 and projecting downwardly below the edge of the lid rim 24. The lid ribs 34 are spaced apart a distance which is slightly less than the distance which the container ribs are spaced apart.

An aperture 36 is formed through the thickness of each lid rib 34. The lid ribs 34 are positioned between the container ribs 30, with the apertures 36 of the lid ribs receiving the corresponding mounting pins 32 of the container ribs. In this way, the lid is secured to the container and positionable in a first position, where it rests on the container rim 16 to cover the open end 14 of the container, and a second position, where it is in a substantially vertical, upright position uncovering the open end of the container.

The container rim 16 extends continuously about the periphery of the container except in two places where it terminates in pairs of parallel, spaced apart rim walls 38, as shown in FIG. 15. Actually, the container ribs 30 may be formed merely as extensions of one rim wall 38 of each pair. The rim walls 38 of each pair thus define slots 40 formed in the container rim, and are spaced apart a distance which is slightly greater than the thickness of the lid hinge members 34 so that the lid hinge members can be closely received in the slots 40 defined by adjacent rim walls. This close fit in the slots helps keep the lid hinge members properly mounted on the mounting pins 32, and allows the lid to be more closely seated on the container rim.

Figure 5:
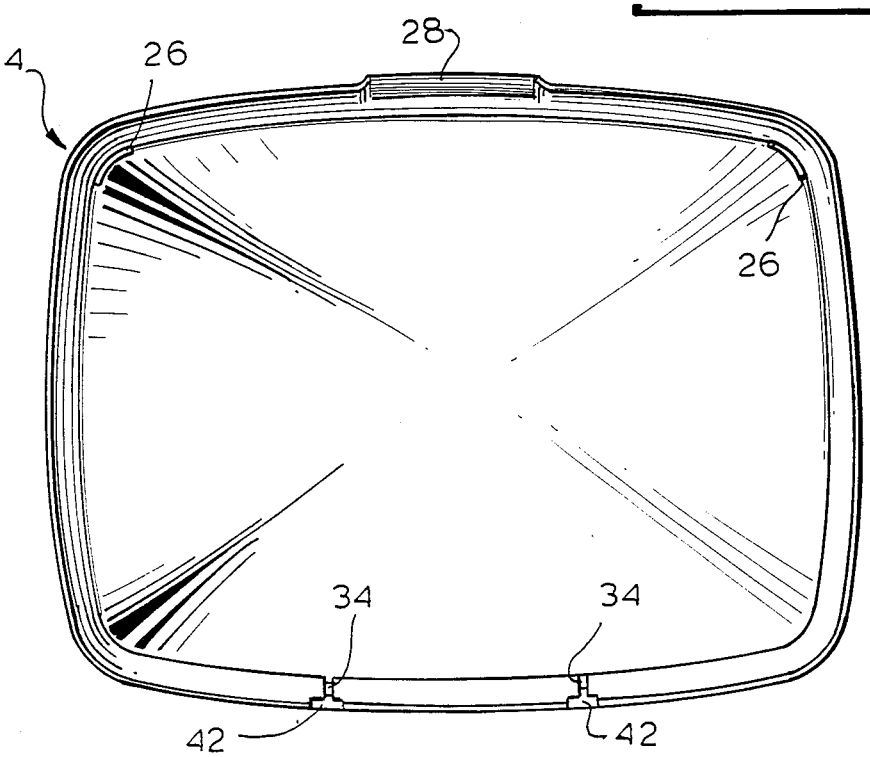
FIG. 5 is an elevational view of the underside of the wastebasket lid.
Figure 6:
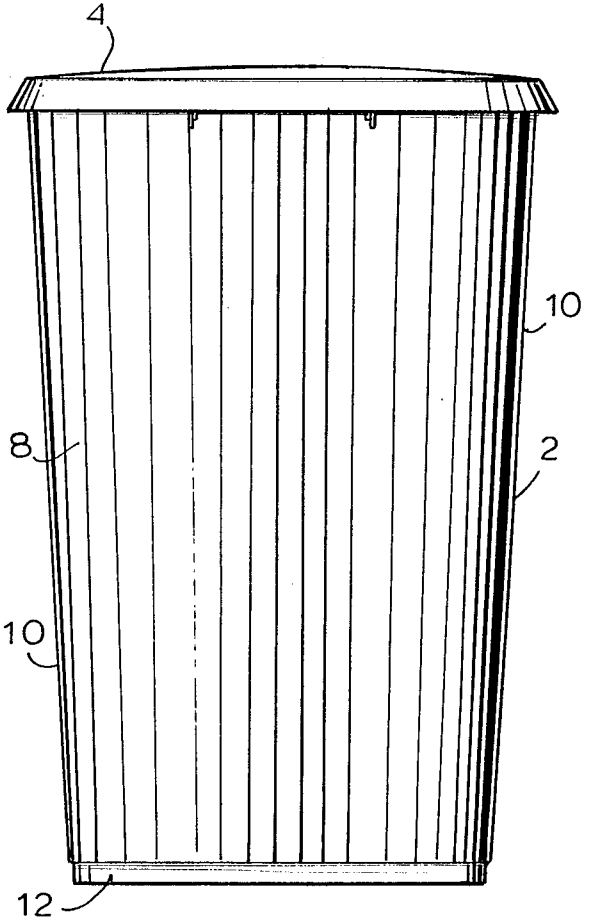
FIG. 6 is a rear elevational view of the wastebasket.
Figure 8:
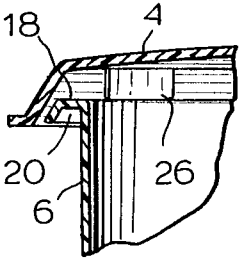
FIG. 8 is an enlarged view of the portion of the wastebasket shown encircled in dashed lines in FIG. 7.
Figure 9:
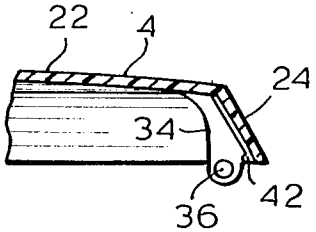
FIG. 9 is a sectional view of a portion of the wastebasket lid.
Figure 7:
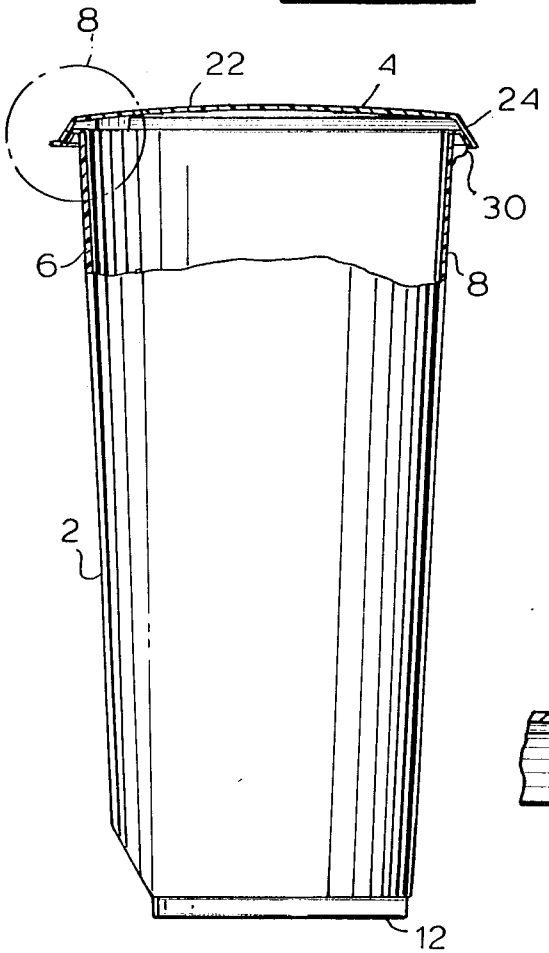
FIG. 7 is a side elevational view of the wastebasket, with the side wall partially broken away.

The lid 4 also includes latch members which cooperate with the container ribs 30 to maintain the lid in an upright, open position. The lid latch members are preferably protrusions 42 constituting thickened portions of the edge of the lid rim 24 on the inside surface of the rim. The protrusions 42 are situated on one side of each lid hinge member 34 or, as shown in FIG. 5, are positioned to straddle each lid hinge member. In either case, the protrusions are positioned in alignment with the container ribs 30 so that they engage the ribs when the lid is in an open position. As will be seen, each lid latch member or protrusion 42 also includes a flat stop surface 44 formed on its underside, which stop surface cooperates with a corresponding container rib 30 to prevent the lid from being pivoted over more than a predetermined arc, as illustrated by arrow A in FIG. 13.

As will now be described, the ribs 30 of the container are particularly shaped to cooperate with the lid latch members 42. Each rib includes an exposed outer edge 46 and an underside edge 48, and a protruding corner 50 interposed between the two. A recess 52 is formed in the underside edge 48 of each rib and is set inwardly from the corner 50, that is, between the corner and the rear side wall 8 of the container.

When the lid is mounted on the container in a position covering the container's open end, the protrusions 42 of the lid latch members are situated at the outer edges 46 of their corresponding container ribs. As the lid is pivotally raised from the container, the protrusions 42 swing away from the outer edges 46 of the ribs to allow the lid to be raised unimpeded and with little effort. However, the exposed corners 50 of the container ribs reside directly in the arc of swing of the lid latch protrusions 42.

Because the lid latch members are primarily thickened portions of the lid rim 24 whose bottom edge is free-standing, the lid latch members are resiliently yieldable and are displaced outwardly when the protrusions 42 engage the corners 50 of the container ribs. The lid latch protrusions 42 thus ride along the container ribs over the corners 50 as the lid is raised.

When the lid is raised to a substantially vertical, upright position uncovering the open end of the container, the protrusions 42 of the lid latch members slidably engage the underside edges 48 of the ribs and resiliently snap into the recesses 52 formed in the ribs. The shape and depth of the recesses 52 conform to the shape of the protrusions 42 to effect a close fit. The lid is retained in the upright position once the lid latch member protrusions 42 are properly seated in the rib recesses 52. Further backward movement of the lid with respect to the container is limited by the stop surface 44 of the lid hinge members engaging a stop edge 54 formed on the underside edge 48 of the container ribs and partially defining the recesses 52.

To close the lid, the user merely exerts a downward force on the lid sufficient to dislodge the protrusions 42 from the recesses 52 and to cause them to ride back over the corners 50 of the ribs.

The wastebasket of the present invention is simple in construction and may be formed with only two interconnected cooperating components—the lid and the container. Thus, assembly of the wastebasket is quite simple and may be performed by the ultimate consumer. The wastebasket is adapted to receive a flexible inner liner, with the material surrounding the open end of the liner being draped over the side walls of the container.

With the lid latching mechanism described above, the lid may be retained in an upright position, completely unobstructing the open end of the container. The lid will latch into this position and will not fall even when a filled inner liner is removed.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A wastebasket, which comprises:

a container having an upper rim defining an open end;

a lid mounted on the container at the upper rim thereof, which lid is positionable to cover and uncover the open end;

means for pivotally mounting the lid on the container, the lid being positionable in a first position, wherein it covers the open end of the container, and a second position, wherein it is disposed in a substantially upright position uncovering the open end; and means for latching the lid in the upright second position, the lid latching means including cooperatingly engageable portions of the lid and container, one of the portions being resiliently yieldable and the other of the portions having a recess formed therein which is adapted to receive the resiliently yieldable portion to retain the lid in the upright second position, the container portion of the latching means being formed as a rib extending downwardly from the container rim on the outside of the container, the rib having an underside edge in which the recess is formed, the lid portion of the latching means being resiliently yieldable and including a protrusion, the protrusion being adapted to engage the container rib and be received and retained by the rib recess, the rib further including a protruding corner, the protruding corner being disposed in the path of radial movement of the lid protrusion so as to cause the lid protrusion to be displaced outwardly when the protrusion engages the rib corner, the recess being disposed on the underside edge of the rib between the corner and the container whereby pivotal movement of the lid from the first position to the second position causes the lid protrusion to engage and pass the rib corner and enter the rib recess.

2. A wastebasket as defined by claim 1, wherein the protrusion of the lid portion of the latching means includes a flat stop surface at the underside of the protrusion; and wherein the container rib includes a stop edge formed on its underside edge and partially defining the recess, the stop surface of the lid portion being adapted to engage the stop edge of the container rib when the lid is in the second position to limit further pivotal movement of the lid.

3. A wastebasket as defined by claim 1, wherein the means for pivotally mounting the lid on the container includes a mounting pin extending outwardly from a side of the container rib, the mounting pin being received by an aperture formed through the thickness of the lid portion of the latching means.

4. A wastebasket, which comprises:

a container having a side wall, and an upper rim defining an open end;

a lid mounted on the container and situated at the upper rim thereof, the lid including a top wall and a rim extending downwardly from the top wall about the periphery thereof, the lid being positionable to cover and uncover the open end of the container, the rim of the lid being adapted to overlie the upper rim of the container, the lid further including support members formed on the underside of the top wall thereof, the support members being positioned to engage the upper rim of the container and rest thereon to support the lid on the upper rim when the lid is positioned to cover the open end of the container;

means for pivotally mounting the lid on the container, the lid being positionable in a first position, wherein it covers the open end of the container, and a second position, wherein it is disposed in a substantially upright position uncovering the open end; and means for latching the lid in the upright second position, the lid latching means including cooperating engagable portions of the lid and container, the lid latching portion including a protrusion joined thereto, the protrusion being resiliently yieldable and having a flat underside surface, the container latching portion including a rib formed on the side wall of the container and extending downwardly from the container upper rim, the rib including an outside edge and an underside edge, and a protruding corner interposed between the outside edge and the underside edge, the rib further including a recess formed in the underside edge thereof, the recess being situated between the corner edge and the side wall of the container, the rib further including a stop edge, the stop edge partially defining the recess, the protrusion of the lid latching portion being swingable in an arc when the lid is moved between the first and second positions, the corner of the rib residing in the arc of movement of the protrusion such that the protrusion engages the rib corner and is displaced thereby, the protrusion being received and retained by the recess when the lid is positioned in the upright second position, the stop surface of the protrusion engaging the stop edge of the rib to prevent further pivotal movement of the lid beyond the second position.

5. A wastebasket which comprises:

a container having an upper rim defining an open end;

a lid mounted on the container at the upper rim thereof, which lid is positionable to cover and uncover the open end;

means for pivotally mounting the lid on the container, the lid being positionable in a first position, wherein it covers the open end of the container, and a second position, wherein it is disposed in a substantially upright position uncovering the open end; and means for latching the lid in the upright second position, the lid latching means including cooperatingly engageable portions of the lid and container, one of the portions including a resiliently yieldable protrusion and the other of the portions being a rib having a recess formed therein which is adapted to receive the resiliently yieldable protrusion to retain the lid in the upright second position, the container portion of the latching means extending downwardly from the container rim on the outside of the container, the rib having an edge in which the recess is formed, the protrusion being adapted to engage the rib and be received and retained by the rib recess, the rib further including a protruding corner, the protruding corner being disposed in the path of relative radial movement of the protrusion so as to cause the protrusion to be displaced outwardly when the protrusion engages the rib corner, whereby pivotal movement of the lid from the first position to the second position causes the protrusion to engage and pass the rib corner and enter the rib recess.

6. A wastebasket as defined by claim 1, wherein the lid includes support members protruding from the underside thereof, the support members being positioned to rest on the upper rim of the container and to support the lid on the upper rim when the lid is in the first position.

* * * * *